US012024973B2

(12) United States Patent
Eldevik

(10) Patent No.: US 12,024,973 B2
(45) Date of Patent: Jul. 2, 2024

(54) WELL TOOL DEVICE FOR FORMING A PERMANENT CAP ROCK TO CAP ROCK BARRIER AND METHOD FOR USING SAME

(71) Applicant: Interwell P&A AS, Hafrsfjord (NO)

(72) Inventor: Terje Vemøy Eldevik, Ellingsøy (NO)

(73) Assignee: INTERWELL P&A AS, Hafrsfjord (NO)

( * ) Notice: Subject to any disclaimer, the term of this patent is extended or adjusted under 35 U.S.C. 154(b) by 119 days.

(21) Appl. No.: 17/601,842

(22) PCT Filed: Apr. 17, 2020

(86) PCT No.: PCT/EP2020/060935

§ 371 (c)(1),
(2) Date: Oct. 6, 2021

(87) PCT Pub. No.: WO2020/216693

PCT Pub. Date: Oct. 29, 2020

(65) Prior Publication Data

US 2022/0195833 A1 Jun. 23, 2022

(30) Foreign Application Priority Data

Apr. 24, 2019 (NO) ..... 20190537

(51) Int. Cl.
*E21B 33/13* (2006.01)
*E21B 29/02* (2006.01)

(52) U.S. Cl.
CPC ..... *E21B 33/13* (2013.01); *E21B 29/02* (2013.01)

(58) Field of Classification Search
CPC ..... E21B 33/13; E21B 29/02
See application file for complete search history.

(56) References Cited

U.S. PATENT DOCUMENTS

2006/0144591 A1* 7/2006 Gonzalez ..... E21B 29/10 166/57
2010/0230118 A1 9/2010 Fabre et al.
(Continued)

FOREIGN PATENT DOCUMENTS

WO 2013/135583 9/2013
WO 2017/097663 6/2017
(Continued)

OTHER PUBLICATIONS

Frank M. Mortensen, "A new P&A technology for setting the permanent barriers", Master's Thesis, Master of Science: Petroleum Technology, Drilling, University of Stavanger, 2016.
(Continued)

*Primary Examiner* — Catherine Loikith
(74) *Attorney, Agent, or Firm* — Wenderoth, Lind & Ponack, L.L.P.

(57) ABSTRACT

A well tool device having a movable partition device within a housing, the partition device separating an inner volume of the housing into a first compartment and a second compartment, a pyrotechnic mixture in the first compartment, and a fluid line providing fluid communication between the second compartment and an outside of the housing. A method includes, while running the well tool device into the well, equalizing a pressure difference between the second compartment and an ambient pressure outside of the housing, by means of allowing fluids to enter the second compartment through the fluid line, while running the well tool device into the well, equalizing a pressure difference between the first compartment and a pressure inside the second compartment, by means of the partition device being affected by the pressure inside the second compartment, installing the well tool device in the well, and igniting the pyrotechnic mixture.

7 Claims, 4 Drawing Sheets

(56) References Cited

U.S. PATENT DOCUMENTS

| | | | |
|---|---|---|---|
| 2011/0174484 | A1 | 7/2011 | Wright et al. |
| 2015/0211322 | A1 | 7/2015 | Lowry et al. |
| 2018/0094504 | A1 | 4/2018 | Hearn et al. |
| 2019/0085659 | A1 | 3/2019 | Carragher et al. |

FOREIGN PATENT DOCUMENTS

| | | |
|---|---|---|
| WO | 2017/137226 | 8/2017 |
| WO | 2018/057361 | 3/2018 |
| WO | 2018/063829 | 4/2018 |

OTHER PUBLICATIONS

A New Approach to Wall Abandonment, Part III, published by Interwell, Jan. 2017.
International Search Report issued Jul. 10, 2020 in International (PCT) Application No. PCT/EP2020/060935.
Search Report issued Nov. 22, 2019 in Norwegian Application No. 20190537.

* cited by examiner

WELL TOOL DEVICE FOR FORMING A PERMANENT CAP ROCK TO CAP ROCK BARRIER AND METHOD FOR USING SAME

TECHNICAL FIELD

The invention relates to a well tool device and a method for permanently plugging and abandoning a well.

BACKGROUND OF THE INVENTION

Plugging and abandonment operations, often referred to as P&A operations, are performed to permanently close oil and/or gas wells. Typically, this is performed by providing a permanent well barrier above the oil and/or gas producing rock types, typically in the cap rock in which the well has been drilled through.

In WO2013/135583 (Interwell P&A AS), it is disclosed method for performing a P&A operation wherein a first step, it was provided an amount of a pyrotechnic mixture (for example thermite) at a desired location in the well and thereafter to ignite the pyrotechnic mixture to start a heat generation process. It is also disclosed a tool for transporting the pyrotechnic mixture into the well before ignition.

The transportation tool must store and protect its content until it has reached the intended position in the well. It is therefore of key importance that the tool can withstand the increasing ambient pressure exerted on it as it is lowered into the well. In the event of a collapse, the content of the tool will likely be destroyed and lost. A collapsed tool can also be difficult if not impossible to install in the well. To withstand external pressure, tools are typically made of expensive high strength materials or their wall thickness is increased which require more material which in turn increase cost.

An objective of the present invention is to provide a tool which solves the identified problem without the above-mentioned disadvantages.

SUMMARY OF THE INVENTION

The invention relates to a well tool device for forming a permanent well barrier as well as a method for forming a permanent well barrier as set forth in the independent claims. Preferred embodiments are set forth in the dependent claims.

It is described a well tool device for forming a permanent cap rock to cap rock barrier which seals against a reservoir in a well, the well tool device comprising:

- a housing;
- a movable partition device provided within the housing, the partition device separating an inner volume of the housing in a first volume defining a first compartment and a second volume defining a second compartment;
- a pyrotechnic mixture for melting surrounding materials to form the cap rock to cap rock barrier when solidifying, provided in the first compartment; and
- a fluid line providing fluid communication between the second compartment and an outside of the housing.

It is thus achieved a well tool device which equalizes the differential pressure between the inside of the well tool device and an ambient pressure. This enables the housing to be produced with a thinner wall thickness or by materials with lower strength, compared to prior art well tools which doesn't equalize said differential pressure and thus have to withstand pressure differences of up to several hundred bars between an outside and an inside of the well tool device when installed at a location deep in a well. Collapse of the housing when (i.e. during) running of the tool into a well with increasingly higher pressure is also avoided.

The partition device may be a piston, a diaphragm or a bladder.

The well tool device may be used in both onshore and offshore wells.

The well tool device may comprise:

- a valve device providing fluid communication between the first compartment and the outside of the housing.

It is thus achieved a well tool device which may vent and/or fill the first compartment with fluids prior to running the tool into the well.

The first compartment may be fluid tight. Such a compartment is advantageous when using pyrotechnic mixtures which must be kept dry in order for the pyrotechnic mixture to efficiently ignite and react.

The ignition device may be wired to surface or alternatively be connected to a timer and a battery providing power for the ignition device to ignite the pyrotechnic mixture.

As used herein, the term "pyrotechnic mixture" or "heat generating mixture" is a particulate mixture of a first metal and an oxide of a second material which, when heated to an ignition temperature, will react spontaneously in an exothermic and self-sustained chemical reaction where the first metal is oxidized to a metal oxide and the second metal is reduced to elementary metal. I.e. the pyrotechnic mixture can be defined as any substance or mixture of substances designed to produce an effect by heat, light, sound, gas/smoke or a combination of these, as a result of non-detonative self-sustaining exothermic chemical reactions. Pyrotechnic substances do not rely on oxygen from external sources to sustain the reaction.

An example of a possible reaction may be the reaction between particulate ferric oxide and particulate aluminium:

$$Fe_2O_3+2Al \rightarrow 2Fe+Al_2O_3$$

Other examples are presented in the detailed description below:

The Pyrotechnic Process

The heat generating mixture (pyrotechnic mixture) 40 comprises a particulate of a first metal and a particulate metal oxide of a second metal in an over-stoichiometric amount relative to a red-ox reaction.

The first metal is oxidized to a metal oxide and the second metal is reduced to elementary metal where the first metal is a different metal than the second metal. Heat is a result of this reaction.

One example of such a pyrotechnic mixture is the following:

$$Fe_2O_3+2Al \rightarrow 2Fe+Al_2O_3+heat \quad (1)$$

Here, the first metal is aluminum (Al) and the second metal is iron oxide (Fe2O3). The first metal is oxidized to the metal oxide aluminum oxide (Al2O3) and the second metal is reduced to the elementary metal iron (Fe). Heat is produced during this process, which often is referred to as a thermite process.

In the above example, the first metal is more reactive than the second metal as defined in a reactivity series of metals.

In alternative embodiments for such a reaction, the first metal in the heat generating mixture or pyrotechnic mixture may be of the following metals: Mg, Al, Ti, Mn, V, Zn, Cr, Mo, Fe, Co, Ni, Sn, Pb, Cu, or B and the metal oxide of the second metal is one of: copperII oxide, chromiumIII oxide, ironII, III oxide, manganeseIV oxide, silicon dioxide, boron trioxide, or leadII, IV oxide. When combining the above, the first metal is more reactive than the second metal as defined in a reactivity series of metals.

Some examples of alternative processes, in which the first metal is aluminum, are disclosed below:

$$Fe_2O_3+2Al \rightarrow 2Fe+Al_2O_3+heat \quad (2)$$

$$3Fe_3O_4+8Al \rightarrow 9Fe+4Al_2O_3+heat \quad (3)$$

$$3MnO_2+4Al \rightarrow 3Mn+2Al_2O_3+heat \quad (4)$$

$$Mn_2O_3+2Al \rightarrow Mn+Al_2O_3+heat \quad (5)$$

$$3SiO_2+4Al \rightarrow 3Si+2Al_2O_3+heat \quad (6)$$

It should be noted that the heat produced in the above processes will vary from process to process. In addition, the speed of the reaction will vary from process to process.

As mentioned above, it is also possible to use manganese as the first metal, as disclosed below:

$$Fe_2O_3+3Mg \rightarrow 2Fe+3MgO+heat \quad (7)$$

As used herein, the term "the first metal is more reactive than the second metal" means that the first metal of the pyrotechnic mixture has a higher reactivity than the second metal of the metal oxide. The reactivity of metals is determined empirically and given in reactivity series well known to the person skilled in the art. An example of a reactivity series of metals is found in e.g. Wikipedia: https://en.wikipedia.org/wiki/Reactivity_series After ignition of the pyrotechnic mixture e.g. at the depth of the cap rock, the heat generating mixture will burn with a temperature of up to 3000° C. and melt a great part of the proximate surrounding materials, with or without the addition of any additional metal or other meltable materials to the well. Such a pyrotechnic mixture may also be referred to as a heat generating mixture. The surrounding materials may include any material normally present in the well, and can be selected from a group comprising, but not limited to: tubulars, e.g. casing, tubing and liner, cement, formation sand, cap rock etc. The heat from the ignited mixture will melt a sufficient amount of said materials. When the heat generating mixture has burnt out, the melted materials will solidify forming the reservoir sealing barrier at the first position. If the first position is at the cap rock, the reservoir sealing barrier melts and bonds in a transition area with the cap rock forming a continuous cap rock-to-cap rock barrier. This reservoir sealing barrier seals from inflow from any reservoir(s) below the reservoir sealing barrier. The operation is particularly suitable in vertical sections of the well, but may also be suitable in deviating or diverging sections such as horizontal sections or sections differing from a vertical section.

The sufficient amount of heat generating mixture or pyrotechnic mixture, e.g. thermite mixture, varies dependent on which operation that is to be performed as well as the design well path. As an example, NORSOK standard D-010, which relates to well integrity in drilling and well operations, defines that a cement plug shall be at least 50 meters and in some operations up to 200 meters when used in abandonment operations. For example, one may fill whole of the inner volume of the pipe. In the embodiment regarding permanent well abandonment, a pipe having an inner diameter of 0.2286 m (9⅝") has a capacity of 0.037 $m^3$ per meter pipe. In order to provide a 50 meter plug by means of the method according to the invention, one would need 1.85 $m^3$ heat generating mixture comprising thermite. Similarly, if a cement plug of 200 meters is required, the amount of heat generating mixture needed would be 7.4 $m^3$. It should though be understood that other plug dimensions may be used, as the plug provided by means of the invention will have other properties than cement and the NORSOK standard may not be relevant for all applications and operations. Any amount of heat generating mixture may be used, dependent on the desired operation, the properties of the heat generating mixture and the materials.

The well tool device may comprise:

an ignition device provided within the first compartment, suitable for igniting the pyrotechnic mixture.

When one or several well tool devices are adjacently installed in a well or a plurality of well tool devices are run and installed as a stack, at least one well tool device needs an ignition device suitable for ignite the pyrotechnic mixture. Once the pyrotechnic mixture of one well tool device is ignited, it will in turn ignite the pyrotechnic mixture of any adjacent well tool devices.

It is described a method for forming a permanent cap rock to cap rock barrier which seals against a reservoir in a well, using a well tool device, the well tool device comprising:

a housing;

a movable partition device provided within the housing, the partition device separating an inner volume of the housing in a first volume defining a first compartment and a second volume defining a second compartment;

a pyrotechnic mixture provided in the first compartment; and a fluid line providing fluid communication between the second compartment and an outside of the housing;

wherein the method comprises the steps of:

while running the well tool device into the well, equalizing a pressure difference between a pressure inside the second compartment and an ambient pressure outside of the housing, by means of allowing fluids to enter the second compartment through the fluid line;

while running the well tool device into the well, equalizing a pressure difference between a pressure inside the first compartment and a pressure inside the second compartment, by means of the partition device being affected by the pressure inside the second compartment;

installing the well tool device in the well;

igniting the pyrotechnic mixture thereby melting surrounding materials; and waiting a period of time, thereby allowing the melted materials to solidify into a cap rock to cap rock barrier which seals against a reservoir in the well.

It is thus achieved a method for installing the well tool device where the risk of the tool unintentionally collapsing while running into the well is significantly reduced.

The method may comprise the initial step of:

assembling a plurality of well tool devices into one stack.

When several tools are required in the well this will reduce the number of runs. It will also reduce the number of tools requiring an ignition device, as adjacent tools will ignite each other. The well tool device may be lowered by means of a lowering tool, such as e.g. wire line, e-line, drill pipe, a deployment tool, a dedicated running tool, a snubbing tool or coiled tubing.

The relative terms "upper", "lower", "below", "above", "higher" etc. shall be understood in their normal sense and as seen in a cartesian coordinate system. When mentioned in relation to a well, "upper" or "above" shall be understood as a position closer to the surface of the well (relative to another component), contrary to the terms "lower" or "below" which shall be understood as a position further away from the surface of the well (relative another component).

By the use of the described invention, all operations can be performed onshore and, if in water, from a light well intervention vessel or similar, and the need for a costly rig is eliminated. Prior to the ignition of the heat generating mixture, the well may be pressure tested to check if the seal is tight. This might be performed by using pressure sensors or other methods of pressure testing known to the person skilled in the art.

BRIEF DESCRIPTION OF THE DRAWINGS

The invention will now be described with reference to the exemplifying non-limiting embodiments shown in the accompanying drawings, wherein.

DETAILED DESCRIPTION OF A PREFERENTIAL EMBODIMENT

Figure 1:
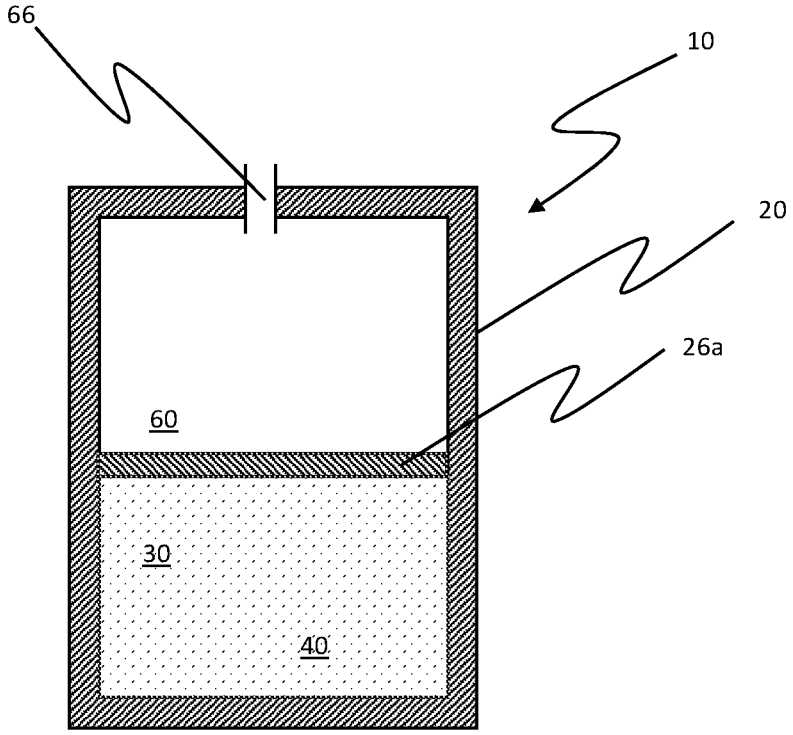
FIG. 1 shows a cross-section of an embodiment of the invention.

FIG. 1 shows a schematic illustration of a vertical cross section of a well tool device 10 according to the invention. The well tool device 10 comprises a housing 20, a partition device 26*a*, 26*b*, 26*c* and a fluid line 66.

The partition device 26*a*, 26*b*, 26*c* is arranged inside the housing 20 in such a way that it separates the inner volume of the housing 20 in two. On a first side (a lower side in the Figures) of the partition device 26*a*, 26*b*, 26*c* is a first compartment 30 defined by the housing 20 and the partition device 26. On a second side (an upper side in the Figures) of the partition device 26*a*, 26*b*, 26*c* is a second compartment 60 defined by the housing 20 and the partition device 26.

The partition device 26*a*, 26*b*, 26*c* in FIG. 1 is in the form of a piston 26*a*. This piston 26*a* can move freely within the housing 20 while sealing against the inner wall of the housing 20. By moving the piston 26*a* in a given direction to increase the volume of the first compartments 30, the volume of the second compartment 60 will have a similar decrease and vice versa.

The fluid line 66 provides fluid communication between the inside of the housing 20 and the outside of the housing 20. The outside of the housing is the environment, and may be at surface where typically air is surrounding the housing, or may also be in a pressurized well with well fluids with significant pressures of up to several hundred bar. The fluid line 66 in FIG. 1 is an aperture in the wall of the housing 20.

Alternatively, a plurality of apertures may be provided in the wall of the housing 20. The at least one aperture is preferably provided in a wall of the housing 20 along which the piston 26*a* is not moving.

In FIG. 1 fluid communication is only provided between the inside of the second compartment 60 and the outside of the housing 20. The first compartment 30 is completely sealed off from the outside of the housing 20. The first compartment 30 is thus suited for storage of pyrotechnic mixtures 40.

Any differential pressure between the second compartment 60 and the outside of the housing 20 will be equalized by a flow through fluid line 66. Any differential pressure between the first compartment 30 and the second compartment 60 will be equalized by a movement of the partition device 26.

In use, the well tool device 10 is lowered into the well at a predetermined speed. As the well tool device 10 is lowered into the well the ambient pressure will increase. By allowing fluids to enter the second compartment 60 through the fluid line 66, the pressure difference between the inside of the second compartment 60 and the ambient pressure is continuously equalized. At the same time the pressure difference between the first compartment 30 and the second compartment 60 is continuously equalized by the partition device 26.

The fluid line 66 should be dimensioned according to the running speed of the well tool device 10, such that as little differential pressure as possible is allowed to build up during running. Dimensioning of the fluid line 66 may include sizing of the aperture, the number of apertures and the positioning of apertures. The fluid line 66 may be provided with plugging means during transportation and assembly.

After the well tool device has been lowered into the desired position in the well, it may be installed. Subsequently, the pyrotechnic mixture 40 may be ignited either by an ignition head 50 or by an adjacent well tool device 10.

Prior to running the well tool device 10 into the well, a plurality of well tool devices may be assembled into a stack of well tool devices 10.

Figure 2:
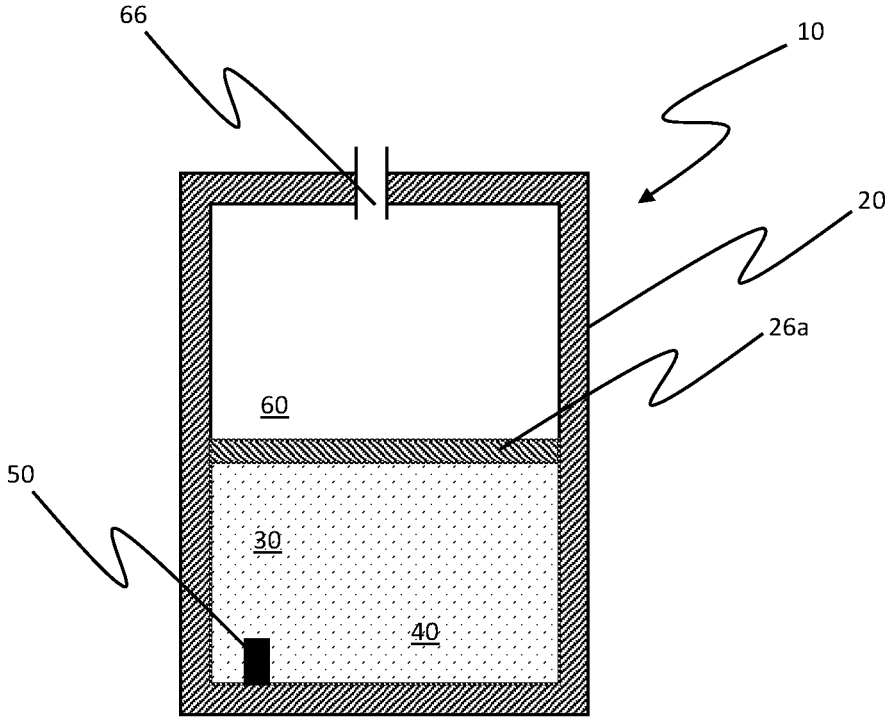
FIG. 2 shows a cross-section of another embodiment of the invention.

FIG. 2 shows a similar well tool device 10 as FIG. 1. The well tool device 10 in FIG. 2 has the additional feature of an ignition head 50. This ignition head 50 is suitable for igniting the pyrotechnic mixture 40.

If several well tool devices 10 are run as a stack or adjacently installed in the well, only one of the well tool devices 10 require an ignition head 50. The pyrotechnic mixture in the first well tool device 10 is ignited by the ignition head 50, this reaction will in turn ignite the surrounding well tool devices 10. All embodiments of the well tool device may be made without the ignition head 50.

Figure 3:
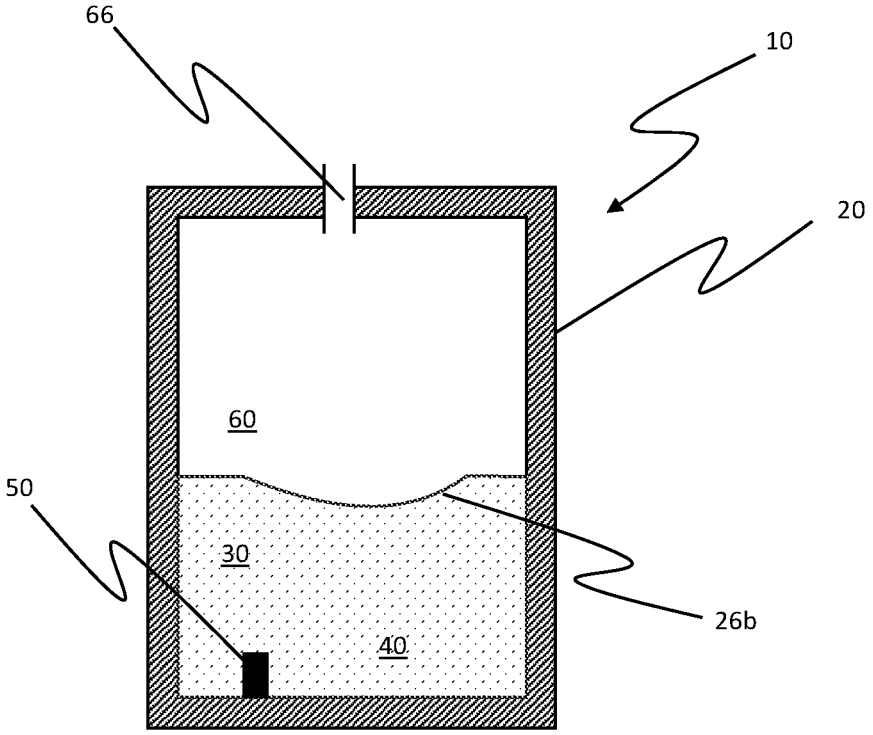
FIG. 3 shows a cross-section of another embodiment of the invention.

FIG. 3 shows a well tool device 10 in which the partition device 26*a*, 26*b*, 26*c* is a diaphragm 26*b*. Unlike the piston 26*a*, the diaphragm 26*b* is anchored to the walls of the housing 10 by means known to the skilled person. This doesn't require the same surface finish on the wall of the housing 20 as the piston 26*a*. By using a diaphragm 26*b*, the fluid line 66 may be positioned in the wall of the housing 20.

Furthermore, the diameter/width of the well tool device doesn't have to be uniform when using a diaphragm 26*b*.

Figure 4:
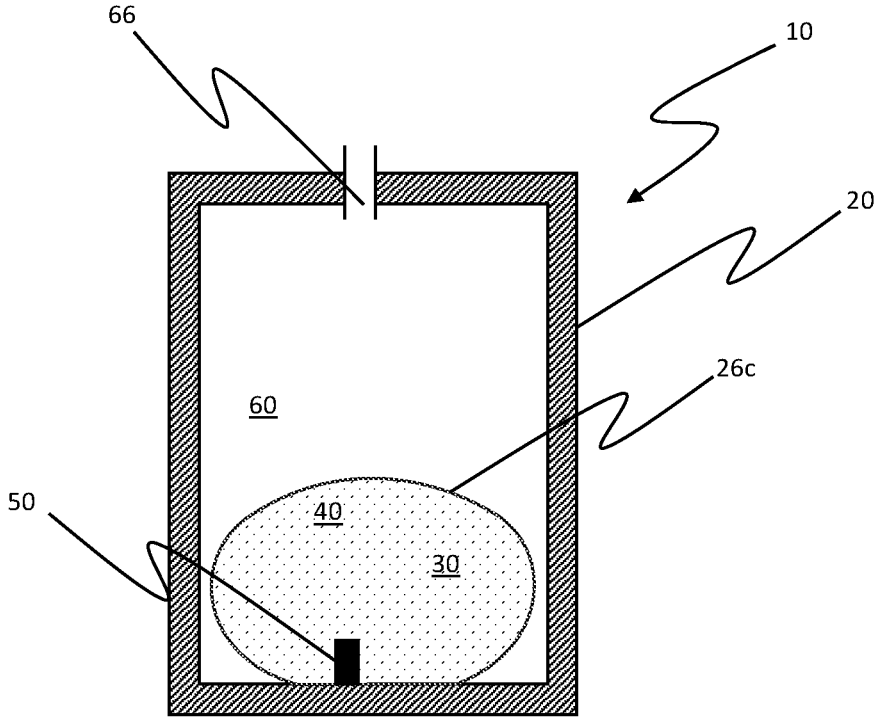
FIG. 4 shows a cross-section of another embodiment of the invention.

FIG. 4 shows a well tool device in which the partition device 26*a*, 26*b*, 26*c* is a bladder 26*c*. Pistons 26*a* and diaphragms 26*b* typically has a circular shape and requires a corresponding shape of the housing 20. The bladder 26*c* is neither anchored to nor moving along the wall of the housing 20. Instead it is anchored to an end surface of the housing 20 by anchoring means known to the skilled person. The bladder 26*c* doesn't require any particular geometry of the housing 20.

If a plurality of well tools 20 are run as a stack, flexibility in the geometry of the well tool device 10 and/or the positioning of the fluid line 66 may be desirable.

Figure 5:
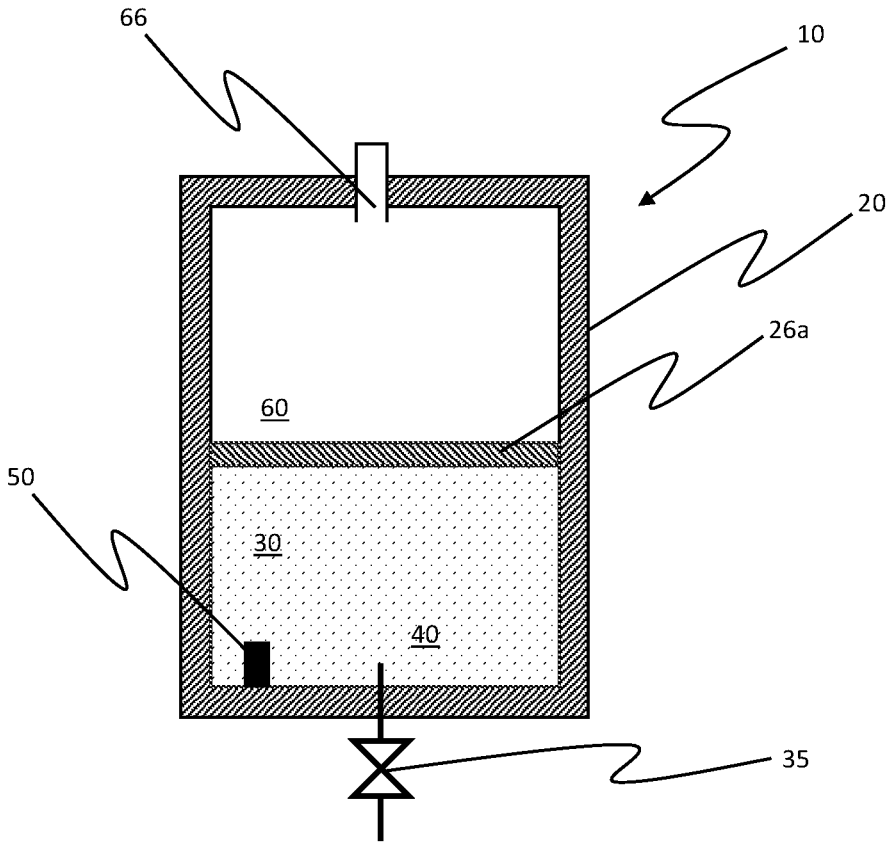
FIG. 5 shows a cross-section of another embodiment of the invention.

FIG. 5 shows a well tool device 10 in which a valve device 35 is provided in the wall of the housing 20. The valve device 35 provides the possibility of fluid communication between the inside of the first compartment 30 and the outside of the housing 20. When the well tool device 10 is run into the well, the valve device 35 is typically closed. Prior to running the well tool device 10 into the well, the valve device 35 may e.g. be used to fill the first compartment 30 with fluids relating to the heat generating process. Prior to running the well tool device 10 it may also be desirable to adjust the partition device 26, e.g. moving the piston 26*a* or diaphragm 26*b* to a position where the first compartment 60 has a larger volume than the volume of the second compartment 60 or pressurizing the bladder 26*c*. This can be achieved by means of the valve device 35.

The valve device 35 may also be adapted to release pressure from the first compartment 30. During the heat generation process, a pressure may build up in the first compartment 30 and a premature collapse of the housing may occur. This pressure build-up may be compensated by the partition device 26. If the partition device 26*a*, 26*b*, 26*c* doesn't fully compensate the pressure build-up, any excess pressure may be vented through the valve device 35.

The valve device 35 may be used in combination with any partition device 26*a*, 26*b*, 26*c*. In a well tool device 10 comprising a partition device 26*a*, 26*b*, 26*c* in the form of a piston 26*a*, the valve device 35 may alternatively be provided in the piston 26*a*.

Figure 6:
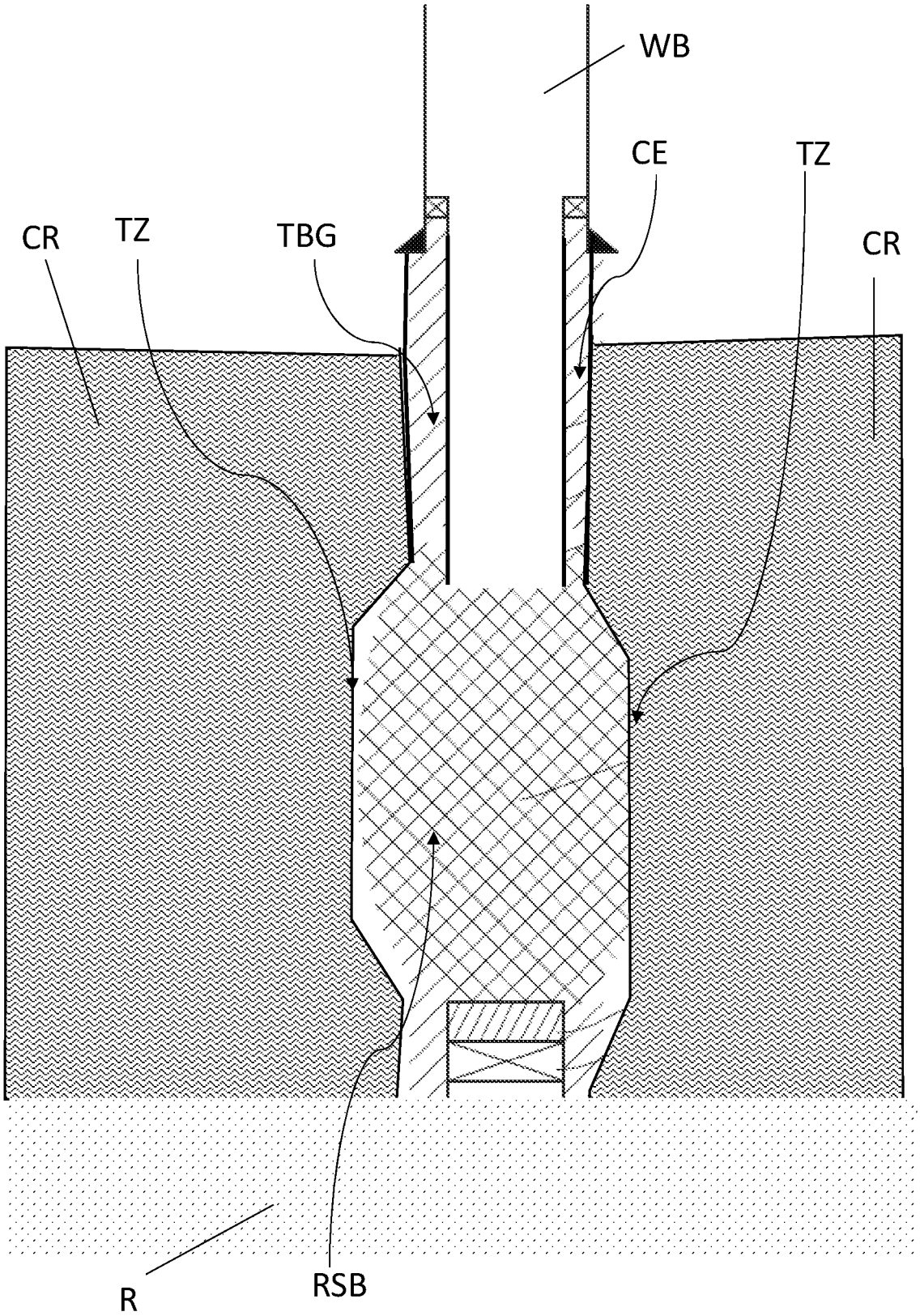
FIG. 6 shows the situation in a well after ignition of the pyrotechnic mixture.

FIG. 6 is a cross section of the well along a vertical plane after the ignition of the pyrotechnic mixture 40 such that proximate surrounding materials present at the position of the pyrotechnic mixture 40 have melted, e.g. tubing or liner TBG, cement CE, cap rock CR, well tool device 10, well tool device housing 20, igniting head 50, other tubulars etc. After waiting a period of time, the melted surrounding materials have solidified into a reservoir sealing barrier or permanent well barrier RSB which seals against the reservoir R in the well bore WB. The sketched area formed in the well bore WB and extending radially into the cap rock CR indicates the melted surrounding materials (i.e. the reservoir sealing barrier RSB which has been formed). The transition areas between non-affected cap rock CR and complete melted materials now forming part of the reservoir sealing barrier RSB is denoted transition zone TZ. In order for a successful reservoir sealing barrier RSB to form, it is advantageous that the bonding between the cap rock CR and the reservoir sealing barrier is satisfactory. Whether the reservoir sealing barrier seals against the reservoir, including in the transition zone, verification test such as pressure tests or sample test(s) of substances not naturally occurring above reservoir sealing barrier RSB can be performed. Such sample tests may be e.g. H2S or other gases. The pressure tests may monitor whether the pressure above the reservoir sealing barrier increases or not.

The invention is herein described in non-limiting embodiments. It should though be understood that the embodiments may be envisaged with a stack comprising two or more well tool devices. The skilled person will understand if it is desirable to set none, one, two or several permanent plugs dependent on the desired operation. Similarly, high temperature resistant elements may be provided at dedicated positions in the well to protect parts of the well or equipment lying contiguous, above or below the position where the plus is set, and may vary from zero, one, two or several, dependent on the operation.

REFERENCE LIST

10—Well tool device
20—Housing
26*a*, 26*b*, 26*c*—Partition device
26*a*—Piston
26*b*—Diaphragm
26*c*—Bladder
30—First compartment
35—Valve device
40—Pyrotechnic mixture
50—Ignition head
60—Second compartment
66—Fluid line
CE—Cement
WB—well bore
CR—Cap rock
R—Reservoir
RSB—reservoir sealing barrier/permanent well barrier
TBG—Tubing
TZ—Transition zone

The invention claimed is:

1. A well tool device for forming a permanent cap rock to cap rock barrier which seals against a reservoir in a well, the well tool device comprising:
- a housing;
- a movable partition device provided within the housing, the partition device separating an inner volume of the housing into a first volume defining a first compartment and a second volume defining a second compartment;
- a pyrotechnic mixture configured to completely melt the well tool device and proximate surrounding materials to form the cap rock to cap rock barrier when solidifying, provided in the first compartment; and
- a fluid line providing fluid communication between the second compartment and an outside of the housing by allowing fluids to enter the second compartment through the fluid line so as to continuously equalize a differential pressure between an inside of the second compartment and an ambient well bore pressure throughout an entirety of a lowering of the well tool device into the well.

2. The well tool device according to claim 1, wherein the partition device is:
- a piston;
- a diaphragm; or
- a bladder.

3. The well tool device according to claim 1, wherein the well tool device further comprises:
- a valve device providing fluid communication between the first compartment and the outside of the housing.

4. The well tool device according to claim 1, wherein the first compartment is fluid tight.

5. The well tool device according to claim 1, wherein the well tool device further comprises:
- an ignition head provided within the first compartment, the ignition head being configured to ignite the pyrotechnic mixture.

6. A method for forming a permanent cap rock to cap rock barrier which seals against a reservoir in a well, using a well tool device, the well tool device comprising:
- a housing;
- a movable partition device provided within the housing, the partition device separating an inner volume of the housing into a first volume defining a first compartment and a second volume defining a second compartment;
- a pyrotechnic mixture provided in the first compartment, the pyrotechnic mixture being configured to completely melt the well tool device and proximate surrounding materials; and a fluid line providing fluid communication between the second compartment and an outside of the housing by allowing fluids to enter the second compartment through the fluid line so as to continuously equalize a differential pressure between an inside of the second compartment and an ambient well bore pressure during throughout an entirety of a lowering of the well tool device into the well;

wherein the method comprises:

while running the well tool device into the well, equalizing the differential pressure by allowing fluids to enter the second compartment through the fluid line;

while running the well tool device into the well, equalizing a pressure difference between a pressure inside the first compartment and a pressure inside the second compartment, by means of the partition device being affected by the pressure inside the second compartment;

installing the well tool device in the well;

igniting the pyrotechnic mixture thereby completely melting the well tool device and the proximate surrounding materials; and waiting a period of time, thereby allowing the completely melted materials to solidify into a cap rock to cap rock barrier which seals against a reservoir in the well.

7. The method according to claim 6, wherein the method further comprises:

assembling a plurality of well tool devices into one stack before the running of the well tool device into the well and the installing of the well tool device in the well.

* * * * *